United States Patent [19]

Shastal

[11] Patent Number: 4,736,858

[45] Date of Patent: Apr. 12, 1988

[54] SELECTIVELY CLOSABLE CONTAINER CLOSURE

[76] Inventor: Eugene D. Shastal, 1149 SE. Coral Reef St., Port St. Lucie, Fla. 33452

[21] Appl. No.: 927,678

[22] Filed: Nov. 6, 1986

[51] Int. Cl.[4] ..... B67D 3/00

[52] U.S. Cl. ..... 215/236; 220/254; 222/517

[58] Field of Search ..... 215/235, 236, 239, 245; 222/153, 517, 556; 220/254, 256

[56] References Cited

U.S. PATENT DOCUMENTS

| | | | |
|---|---|---|---|
| 4,361,250 | 11/1982 | Foster | 220/254 |
| 4,558,806 | 12/1985 | Shabram, Sr. et al. | 222/556 |
| 4,580,687 | 4/1986 | Lewis | 220/254 |

*Primary Examiner*—Stephen Marcus
*Assistant Examiner*—Nova Stucker
*Attorney, Agent, or Firm*—Wood, Dalton, Phillips, Mason & Rowe

[57] ABSTRACT

A closure for selectively closing an opening of a container including a base element arranged to be affixed to a container adjacent an opening therein. An insert having a through opening and defining a recess adjacent the opening is urged sealingly against the container about the opening with its through opening aligned with the container opening. A control element is provided having a pivot portion pivotally mounted to one of the base element and insert at the recess, a stopper portion adapted to be received in the insert opening when the control element is pivoted to a first position, and a presser portion adapted to be engaged by a user's fingertip to pivot the control element to withdraw the stopper portion from the insert opening and dispose the presser portion within the recess at a second position of the control element.

23 Claims, 1 Drawing Sheet

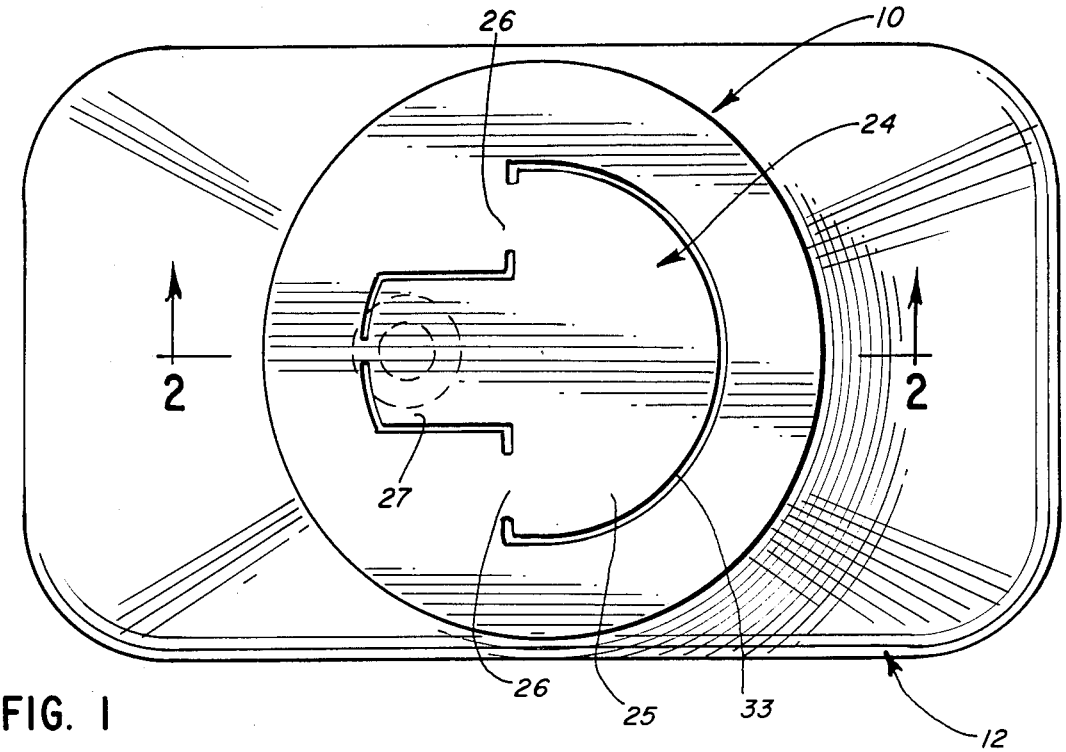
FIG. 1
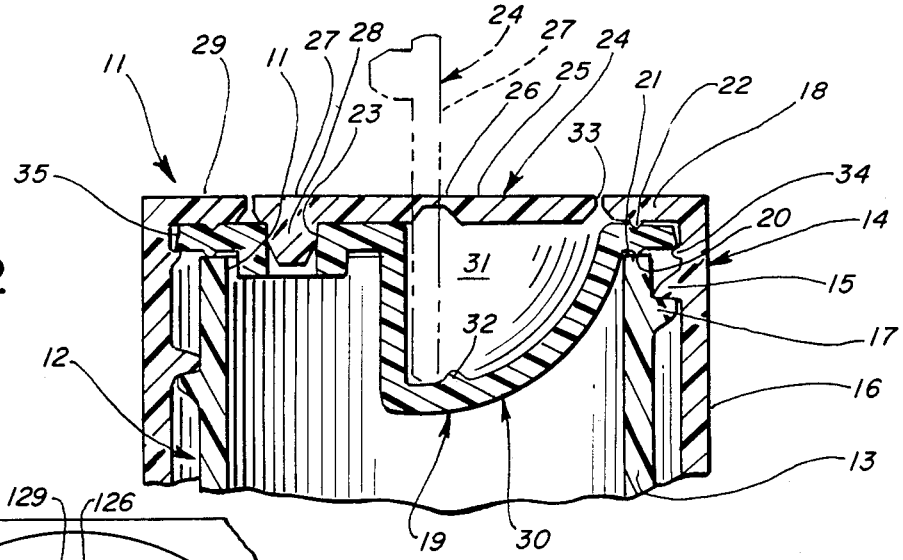
FIG. 2
FIG. 3
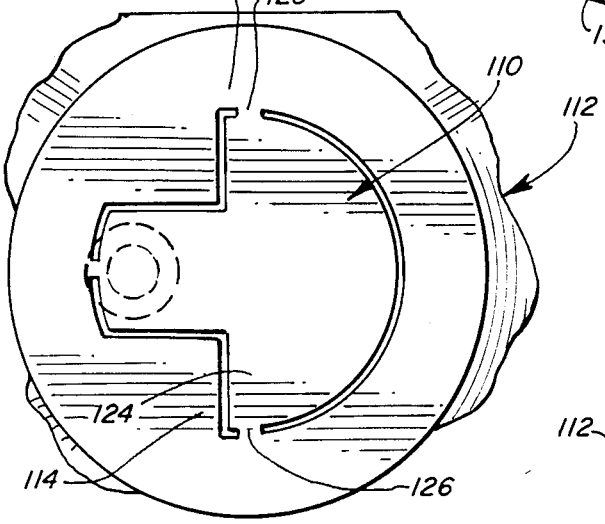
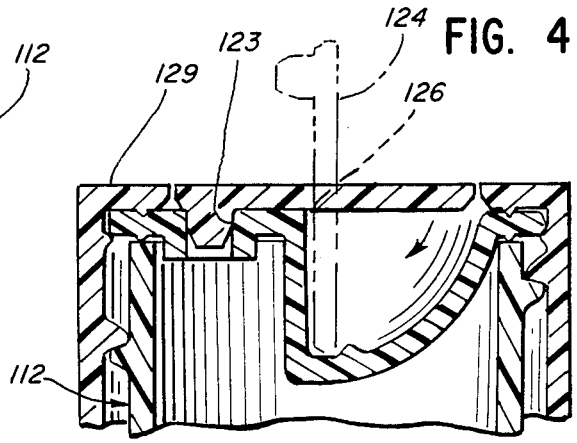
FIG. 4

SELECTIVELY CLOSABLE CONTAINER CLOSURE

TECHNICAL FIELD

This invention relates to container closures and in particular to closures having movable means for selectively closing and opening of a container on which a closure is mounted.

BACKGROUND ART

In one conventional form of closure for controlling delivery of material from a container, the closure is mounted in an opening in an upper wall of the container. The closure defines one or more openings which are selectively closed by an overlying flap. The flap is hingedly mounted to the body of the closure and includes a projecting grasping portion which is exposed when the flap is in the closed position to permit the user to grasp the grasping portion and swing the closure to an upwardly directed position wherein the openings of the closure are exposed to permit passing of material through the container opening and closure opening, such as in dispensing the material from the container.

A serious disadvantage arises in such structure in that the flap tends to remain in somewhat overlying relationship to the openings of the closure so as to inhibit the free flow of material therethrough.

DISCLOSURE OF INVENTION

The present invention comprehends an improved closure for selectively closing and opening of a container wherein means are provided for maintaining a control element portion of the closure in a fully opened position against biasing action tending to urge the control element toward the closed position.

More specifically, the invention comprehends the provision of such a closure including a base element having means for affixation thereof to a container adjacent an opening in the container, an insert having a through opening and defining a recess adjacent the opening, means on the base element for urging the insert sealingly against the container about the opening and with the through opening aligned with the container opening, and a control element having a connecting portion swingably mounted to one of the base element and insert at the recess, a stopper portion adapted to be received in the insert opening when the control element is swung to a first position, and a presser portion adapted to be engaged by a user's fingertip to pivot the control element to withdraw the stopper portion from the insert opening and dispose the presser portion within the recess in a second position of the control element.

In the illustrated embodiment, the container comprises a bottle and the closure is adapted to fit over the neck of the bottle, with the opening of the insert aligned with the distal end of the bottle neck.

The means for retaining the control element releasably in the open position comprises a projection on the portion of the insert defining the recess in the illustrated embodiment.

The control element, in the illustrated embodiment, is integrally hingedly connected to the base member for selective pivotable positioning in the closed first position and open second position.

In the illustrated embodiment, the presser portion of the control element is semicircular and the stopper portion comprises a tongue having a plug element depending from the distal end thereof.

The elements of the closure may be formed of resiliently deflectible material so as to permit facilitated selective positioning and retention of the control element.

In the illustrated embodiment, the base element comprises a cup-shaped element fitted over the distal end of the neck of a bottle container and retaining the insert in sealed association with the end of the neck.

The recess portion of the insert extends into the open end of the bottle neck, whereby the transverse end of the base member extends generally across the open end of the bottle neck.

In the illustrated embodiment, the control element comprises an integral portion of the base element end wall.

Where the bottle neck is provided with a radially outer screw thread, the base element may be provided with a corresponding inwardly directed thread element.

The closures of the present invention are extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a top plan view of a closure embodying a preferred form of the invention mounted on a bottle container;

FIG. 2 is a fragmentary vertical section thereof taken substantially along the line 2—2 of FIG. 1;

FIG. 3 is a fragmentary top plan view of a modified form of closure embodying the invention; and FIG. 4 is a fragmentary vertical section of the embodiment of FIG. 3.

BEST MODE FOR CARRYING OUT THE INVENTION

In the illustrative embodiment of the invention as disclosed in FIGS. 1 and 2 of the drawing, a closure generally designated 10 is shown for selectively closing an opening 11 in a container generally designated 12. In the illustrated embodiment, opening 11 defines the outer distal end of a neck 13 of a bottle container 12. As will be obvious to those skilled in the art, the inventive concept is adapted for use for different forms of containers within the broad scope of the invention.

Closure 10 includes a base element generally designated 14 having means for affixation thereof to the container. In the illustrated embodiment, the affixation means comprises an internal thread 15 on a tubular portion 16 of the closure. Thread 15 cooperates with an outer thread 17 on the bottle neck to secure the base element to the bottle neck, as seen in FIG. 2 of the drawing.

The base element further includes a transversely extending end wall 18 extending across the distal end of the bottle neck when the closure is installed on the neck, as seen in FIG. 2. An insert generally designated 19 is disposed inwardly of base element end wall 18 and includes an annular sealing portion 20 urged sealingly against the distal end 21 of the bottle neck by the end wall 18 of the base element. End wall 18 may be provided with an annular inwardly directed rib 22 aligned with the seal rib 20 to provide sealing force directed through the body of the insert to the sealing rib from the base element.

Insert 19 further defines a through opening 23 communicating with the opening 11 of the bottle neck. The midportion of base element end wall 18 defines a control element 24 including a semicircular presser portion 25, a pair of pivot portions 26, and a stopper portion 27. The stopper portion is provided with a depending plug 28 received in the insert opening 23 when the control element is in a first, closed position, as shown in full lines in FIG. 1.

Pivot portions 26 comprise aligned integral hinge connections at opposite sides of the stopper portion of the base element. Such hinge connections are commonly referred to as living hinges and tend to urge the control element toward the closed position as a result of the resiliency of the material. In the illustrated embodiment, the base element and insert are illustratively formed of resiliently deflectible synthetic resin, such as polyethylene, polypropylene, etc.

The invention comprehends the further provision in insert 19 of a recess portion generally designated 30 projecting into the open end of the bottle neck 13, as seen in FIG. 2. The recess portion defines a well 31 adapted to receive the presser portion 25 of the control element when the presser portion is depressed by the user's finger to withdraw the plug 28 form opening 23 and swing the control element 24 to a second, open position, as shown in broken lines in FIG. 2. The invention further comprehends the provision of means for releasably retaining the control element in the open position, whereby material may be delivered through the opening 23 free of impediment by the control element.

More specifically, as seen in FIG. 2, the recess portion 30 of the insert is provided with an upstanding stop projection 32 cooperating with the peripheral edge portion 33 of the control element presser portion 25 to retain the control element in the upright open position of FIG. 2 against the biasing action of the hinge portions 26. The projection 32 and edge portion 33 define resiliently yieldable cooperating portions of the base element and insert, permitting the controlled movement of the edge portion 33 past the projection 32 in moving to and from the open position of the control element.

To restore the control element to the closed position of FIG. 2, the user need merely press his finger against the stopper portion 27, the deflectibility of the base member and insert permitting the movement of edge portion 33 outwardly past the projection 32 in restoring the plug 28 into closing relationship with opening 23.

It should be noted that hinge 26 tends to maintain the plug 28 in the opening 23 to further effect the desired closure of the opening when the control element is in the closed position of FIG. 2.

The stiffness of the resiliently deflectible control element permits the plug 28 to have a friction fit with the insert in the opening 23 to further enhance the closure of the opening in the closed disposition of the control element.

The control element may be integrally formed with the remainder of the base element, whereby the closure comprises a two-piece structure which may be economically formed by molding from suitable synthetic resins. As shown in FIG. 2, the sidewall 16 of the base element may be provided with an annular inturned flange 34 adapted to receive the peripheral edge portion 35 of the insert and thereby maintain the insert in association with the base element as during installation of the closure on the bottle neck.

In one modified form of the invention as disclosed in FIGS. 3 and 4 of the drawing, a closure generally designated 110 is shown to comprise a closure generally similar to closure 10, but having a modified form of connecting means for swingably connecting the control element 124 to the base element 114.

More specifically, as shown in FIG. 3, the control element is connected to the base element by a pivot connection 126 defined by integral pivot connections between the control element and the surrounding edge portion 129 of the base element.

Thus, as seen in FIG. 4, the connection 126 comprises a twistable connection permitting selective disposition of the control element in the closed position shown in full lines in FIG. 4, and the open position shown in broken lines in FIG. 4. Similarly as described relative to closure 10, closure 110 is arranged to effectively retain the control element in the open position when desired.

In all other respects, closure 110 is similar to and functions in a manner similar to the functioning of closure 10. Elements of closure 110 which are similar to corresponding elements of closure 10 are identified by the same reference numerals but 100 higher.

The foregoing disclosure of specific embodiments is illustrative of the broad inventive concepts comprehended by the invention.

I claim:

1. A closure for selectively closing an opening of a container, said closure comprising:

a base element having means for affixation thereof to a container adjacent an opening in the container;

an insert having a through opening and defining a recess adjacent said insert opening; and means on said base element for securing said insert sealingly against the container about the container opening and with said through opening aligned with said container opening, said base element having formed unitarily integrally therein a control element having a connecting portion swingably joined to said base element, a stopper portion adapted to be received in said insert through opening when the control element is swung to a first position, and a presser portion adapted to be engaged by a user's fingertip to swing the control element to withdraw the stopper portion from said insert opening and dispose the presser portion within said recess in a second position of the control element.

2. The closure structure of claim 1 wherein said base element defines an outer surface and said control element defines an outer surface disposed substantially flush with said base element outer surface when the control element is disposed in said first position.

3. The closure structure of claim 1 wherein said base element defines an outer surface and said control element defines an outer surface disposed substantially flush with said base element outer surface when the control element is disposed in said first position, said control element outer surface extending substantially perpendicularly to said base element outer surface in said second position.

4. The closure structure of claim 1 wherein said base element defines a through opening and said control element is received fully within said opening in said first position.

5. The closure structure of claim 1 wherein said control element defines a midportion and said connecting portion is disposed at said midportion.

6. The closure structure of claim 1 wherein said insert is formed of synthetic resin.

7. The closure structure of claim 1 wherein said presser portion of the control element is semicircular.

8. The closure structure of claim 1 wherein said stopper portion of the control element comprises a tongue defining a distal end, and a plug element depending from said distal end.

9. The closure structure of claim 1 wherein said connecting portion is pivotally mounted in said base element.

10. The closure structure of claim 1 wherein said connecting portion is hingedly mounted in said base element.

11. The closure structure of claim 1 adapted for selectively closing the neck of a bottle, said base element comprising a cup-shaped base element having a tubular sidewall, an end wall, and means on said sidewall for affixation of the base element to the neck of a bottle with said end wall extending across the open end of the bottle neck, said means on said base element for urging said insert comprising means for urging said insert sealingly against the distal end of the bottle neck about the end opening of the neck and with said through opening aligned with said bottle neck end opening, and said connecting portion comprising a hinge portion hingedly mounted to said base element at said recess.

12. The closure structure of claim 11 wherein said recess extends into the bottle neck when the insert is urged sealingly against the distal end of the bottle neck whereby said control element presser portion is received within the bottle neck in said second position of the control element.

13. The closure structure of claim 11 wherein said control element comprises an integral portion of said base element end wall.

14. A closure for selectively closing an opening of a container, said closure comprising:

a base element having means for affixation thereof to a container adjacent an opening in the container;

an insert having a through opening and defining a recess adjacent said insert opening;

means on said base element for securing said insert sealingly against the container about the container opening and with said through opening aligned with said container opening, said base element having formed unitarily integrally therein a control element having a connecting portion swingably joined to said base element, a stopper portion adapted to be received in said insert opening when the control element is swung to a first position and a presser portion adapted to be engaged by a user's fingertip to swing the control element to withdraw the stopper portion from said insert opening and dispose the presser portion within said recess in a preselected fully open second position of the control element; and cooperating retaining means on said insert and said control element for releasably retaining said control element in said preselected second position.

15. The closure structure of claim 14 wherein said retaining means comprises a projection on said insert and an edge portion of said control element.

16. The closure structure of claim 14 wherein said retaining means comprises a projection on said insert in said recess and an edge portion of said control element.

17. The closure structure of claim 14 wherein said presser portion of the control element defines a distal edge portion and a projection is provided on said insert to be releasably engaged by said distal edge portion.

18. The closure structure of claim 14 wherein said retaining means comprises a projection on said insert in said recess and an edge portion of said control element, said projection being disposed to retain said control element in said second position.

19. The closure structure of claim 14 wherein at least one of said insert and said control element is formed of resiliently deflectible material.

20. The closure structure of claim 14 wherein said connecting portion of the control element comprises an integral, twistable connection between said control element and said base element.

21. The closure structure of claim 14 wherein said insert and control element are formed of synthetic resin.

22. The closure structure of claim 14 wherein said connecting portion is pivotally mounted to said base element.

23. The closure structure of claim 14 wherein said connecting portion is hingedly mounted to said base element.

* * * * *